US010635026B2

(12) United States Patent
Garcia et al.

(10) Patent No.: US 10,635,026 B2
(45) **Date of Patent: *Apr. 28, 2020**

(54) DEVELOPER UNIT DRYING

(71) Applicant: HP INDIGO B.V., Amstelveen (NL)

(72) Inventors: Andre Garcia, San Diego, CA (US); Harsh Pranav Desai, San Diego, CA (US); Avinoam Halpern, San Diego, CA (US); Evgeny Korol, San Diego, CA (US); Meir Grinstein, Ness Ziona (IL); Melissa Marie Lovell, San Diego, CA (US)

(73) Assignee: HP Indigo B.V., Amstelveen (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/544,840

(22) Filed: Aug. 19, 2019

(65) Prior Publication Data

US 2019/0369525 A1 Dec. 5, 2019

Related U.S. Application Data

(63) Continuation of application No. 16/073,043, filed as application No. PCT/US2016/029810 on Apr. 28, 2016, now Pat. No. 10,409,200.

(51) Int. Cl.

| | |
|---|---|
| ***G03G 15/11*** | (2006.01) |
| ***G03G 15/10*** | (2006.01) |
| ***G03G 15/06*** | (2006.01) |

(52) U.S. Cl.

CPC ..... *G03G 15/11* (2013.01); *G03G 15/065* (2013.01); *G03G 15/10* (2013.01)

(58) Field of Classification Search

CPC ..... G03G 15/11; G03G 15/065

See application file for complete search history.

(56) References Cited

U.S. PATENT DOCUMENTS

| | | | | |
|---|---|---|---|---|
| 6,317,578 | B1 * | 11/2001 | Kusayanagi | G03G 15/101 399/249 |
| 6,512,907 | B2 | 1/2003 | Nishikawa | |
| 6,850,724 | B2 | 2/2005 | Pang et al. | |
| 9,134,655 | B2 | 9/2015 | Berg et al. | |
| 10,120,300 | B2 * | 11/2018 | Rosenstein | G03G 15/11 |
| 2004/0052549 | A1 | 3/2004 | Baker et al. | |

(Continued)

FOREIGN PATENT DOCUMENTS

| | | |
|---|---|---|
| JP | H05-249819 | 9/1993 |
| WO | WO-2008133631 A1 | 11/2008 |
| WO | WO-2017030580 A1 | 2/2017 |

OTHER PUBLICATIONS

Wei, Z., Improved Deinkability of LEP (Liquid Electrophotography) Digital Prints, Aug. 2013.

*Primary Examiner* — Francis C Gray

(74) *Attorney, Agent, or Firm* — HP Inc. Patent Department

(57) ABSTRACT

In one example, a method for drying a developer unit of a liquid electrophotographic printer. After printing is complete, development voltage biases are applied to the developer unit while a liquid marking agent flows to the developer unit. The liquid marking agent flow to the developer unit is stopped. Drying voltage biases, lower than the development voltage biases, are applied to the developer unit. Idle voltage biases are applied to the developer unit when dry.

19 Claims, 7 Drawing Sheets

(56) References Cited

U.S. PATENT DOCUMENTS

| | | | | |
|---|---|---|---|---|
| 2006/0051142 | A1 | 3/2006 | Naniwa et al. | |
| 2006/0092212 | A1 | 5/2006 | Kawamoto et al. | |
| 2009/0232533 | A1* | 9/2009 | Toyama | G03G 15/11 399/55 |
| 2010/0080585 | A1 | 4/2010 | Booth et al. | |
| 2011/0074894 | A1* | 3/2011 | Sabo | H03G 15/101 347/92 |
| 2012/0195644 | A1* | 8/2012 | Nelson | G03G 15/0808 399/237 |
| 2012/0224887 | A1 | 9/2012 | Harada et al. | |
| 2013/0011162 | A1* | 1/2013 | Nelson | G03G 15/104 399/239 |
| 2013/0149002 | A1* | 6/2013 | Karp | G03G 15/10 399/103 |
| 2015/0071665 | A1* | 3/2015 | Lam | G03G 15/0851 399/60 |
| 2018/0231922 | A1* | 8/2018 | Nelson | G03G 15/11 |
| 2019/0278195 | A1* | 9/2019 | Fujioka | G03G 15/11 |
| 2019/0286009 | A1* | 9/2019 | Kojima | G03G 15/105 |

* cited by examiner

DEVELOPER UNIT DRYING

BACKGROUND

Printers capable of printing monochrome and color images upon paper and other media are ubiquitous and widely used. Such printers encompass a wide range of sizes and printing technologies, from inkjet or laser printers for home or office use to digital printing presses. One technology that can be advantageously utilized in printers is electrophotographic printing. Electrophotographic printers have a photoconductor which may be electrically charged and then selectively discharged to form latent images. The latent images may be developed and transferred to output media to form printed images on the media. Many electrophotographic printers use a liquid marking agent to develop the latent images. It is desirable for electrophotographic printers to produce high quality images and have high reliability.

DETAILED DESCRIPTION

Figure 1:
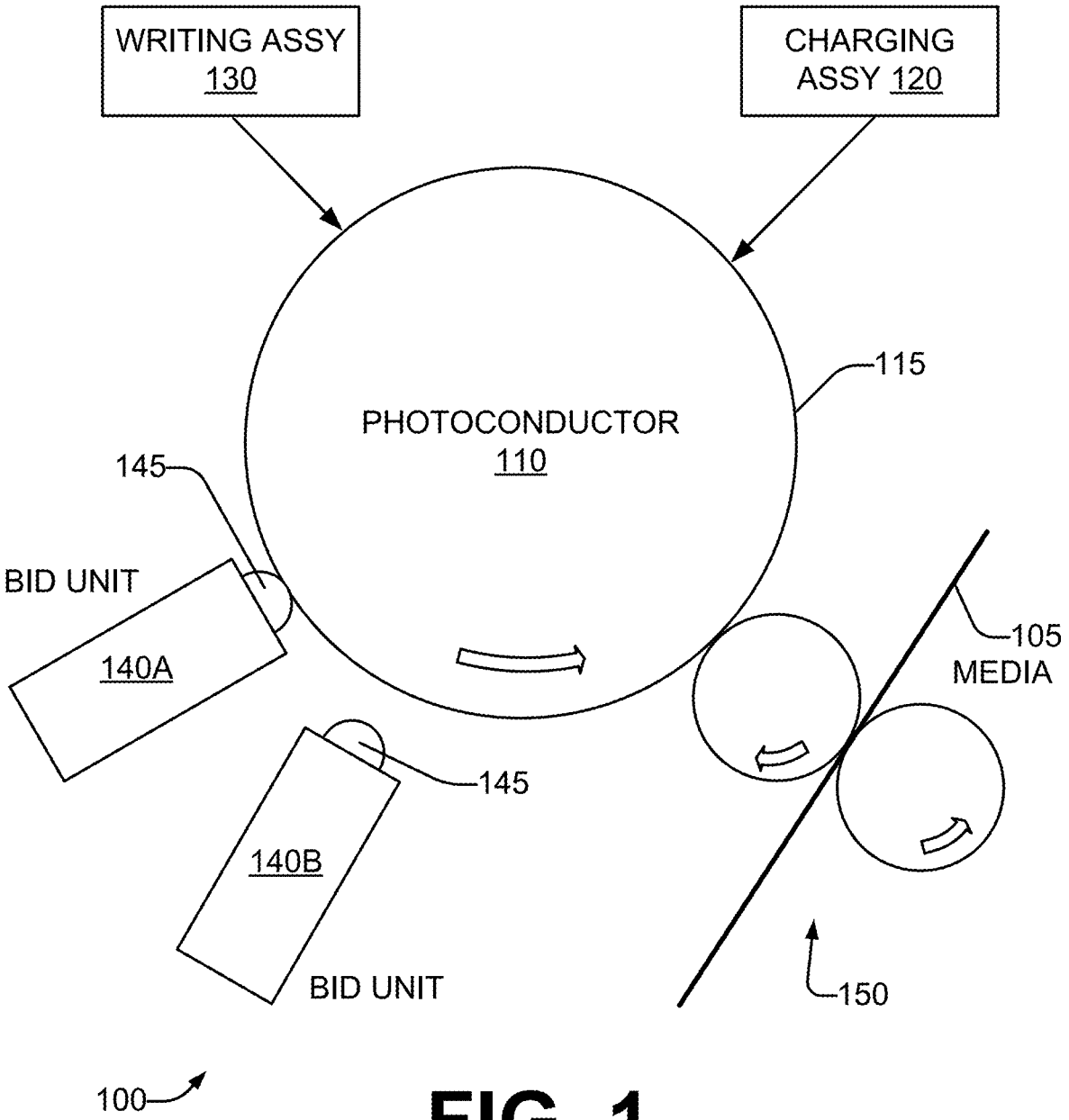
FIG. 1 is a schematic representation of an electrophotographic printer according to an example of the present disclosure.

Electrophotographic printers include a developer unit to develop latent images for transfer onto print output media. Liquid electrophotographic (LEP) printers use a liquid marking agent. One example liquid marking agent includes electrically-chargeable ink particles suspended in a liquid carrier, such as oil. During example development operations using a liquid marking agent, the ink particle concentration of the liquid marking agent is increased by several times in a development assembly and the agent is applied to a photoconductor to develop latent images formed thereon and at least a substantial portion of the remaining liquid carrier evaporates prior to transfer of the ink particles to media. Subsequent use of the term "ink" herein is to be understood as referring to liquid marking agents of various types in addition to ink.

An LEP printer includes at least one binary ink developer (BID) unit to develop the latent images. In some LEP printers, one BID unit is used for each color of liquid marking agent used in the printer.

Each BID unit includes a developer roller (DR), which in many LEP printers is a replaceable and maintainable component. Under certain conditions, undesired artifacts can appear on printed output as a result of ink drying on the DR. Unless the non-developed ink is removed from the BID unit after printing is complete, it can dry into a thin-film residue on the developer roller or elsewhere that causes the artifacts to appear during subsequent printing operations. These artifacts, also known as "ink stains" or "morning marks", can repeat at many positions on the printed media and degrade the image quality. They occur because the ink will not develop or transfer uniformly from the stained areas of the DR.

At the end of every print job, a BID dry routine is automatically executed to remove as much ink as possible from the BID unit. However, if the BID dry routine fails to eliminate the dried ink stains, users may have to reprint jobs which have objectionable print artifacts, and may potentially have to manually clean the developer roller, which causes downtime and expense.

To minimize such situations, the developer roller has a protective coating which both inhibits ink staining, and makes stains which do occur easier to clean manually. However, in some BID units, undesirable wear of the protective coating can occur during the BID dry process. The wear can become excessive in certain BID units in which another roller which contacts the developer roller rotates at a different surface speed from the DR. When the ink that provides lubrication between the two rollers is removed during the BID dry process, the high friction between the rollers caused by the different surface speeds can more rapidly and excessively wear the coating. Once the coating is worn, the developer roller can be very easily stained, such that maintaining it becomes impractical. In addition, the DR can more easily be damaged. Thus, rapid coating wear reduces the lifespan of the developer roller.

Referring now to the drawings, there is illustrated an example of a BID unit of an LEP printer. Voltage sources apply voltages to a developer roller, to other rollers which form nips with the developer roller, and to an electrode that is adjacent the developer roller. After printing is complete, a BID dry routine applies various voltages to these components in a particular sequence, and at particular times in relation to the flow of ink to the developer roller and the amount of ink remaining at the nips, to dry the unit with reduced ink residue in the gaps and the nips. In some examples, the operating speed of the BID unit is adjusted in coordination with the application of the various voltage in order to reduce wear of the coating on the developer roller.

Considering now an electrophotographic printer, and with reference to FIG. 1, an electrophotographic printer 100 is configured to perform electrophotographic printing. The printer 100 includes a photoconductor 110, a charging assembly 120, a writing assembly 130, at least one binary ink developer unit 140 (two units 140A, 140B are illustrated), and a transfer assembly 150. In some examples, the photoconductor 110 is referred to as a photo imaging plate ("PIP"). The printer 100 is configured to form hard images upon media 105, such as paper or other suitable imaging substrates. Other electrophotographic printers 100 may include more, less or alternative components or other arrangements in other implementations.

In one example implementation, charging assembly 120 is configured to deposit a blanket electrical charge upon substantially an entirety of an outer surface 115 of photoconductor 110. Writing assembly 130 is configured to discharge selected portions of the outer surface 115 of the photoconductor 110 to form latent images. Each BID unit 140 is configured to provide a liquid marking agent, often an ink of a different color, to the outer surface 115 of photoconductor 110 to develop the latent images formed thereon. Particles of the liquid marking agent may be electrically charged to the same electrical polarity as the blanket charge provided to the outer surface 115 of the photoconductor 110, and may be attracted to the discharged portions of the outer surface 115 of the photoconductor 110 corresponding to the latent images so as to develop the latent images. The developed images are then transferred by transfer assembly 150 onto media 105.

Each binary ink developer unit 140 includes a developer roller 145. The developer roller 145 contacts the photoconductor 110 during the process of developing the latent image. In examples, no other roller of the BID 140 contacts the photoconductor 110 during the process of developing the latent image A single developer unit 140 can be used for monochrome electrophotographic printer. Plural developer units 140 can be used for printing different colors of a color electrophotographic printer. In one example the BID units 140 may be spaced from the photoconductor 110 when the BID units 140 are not developing latent images, and may be individually moved to a development position such that the BID 140 provides the appropriate color marking agent to the photoconductor 110 at an appropriate moment in time to develop latent images on the photoconductor 110. For example, BID unit 140A is in contact with the photoconductor 110 to develop one color of the latent image as depicted in FIG. 1, while BID unit 140B is spaced apart from the photoconductor 110.

Figure 2:
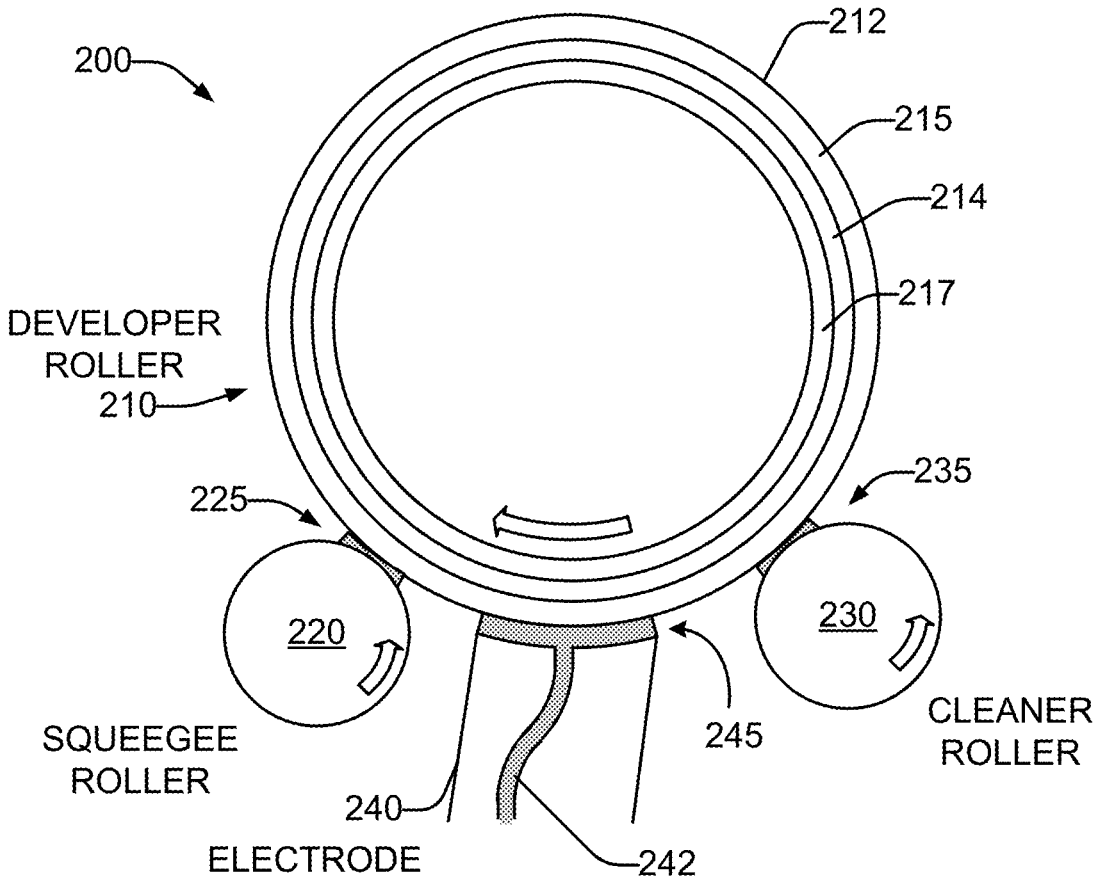
FIG. 2 is a schematic representation of a developer unit according to an example of the present disclosure and usable in the electrophotographic printer of FIG. 1.

Considering now in greater detail a developer unit usable in an electrophotographic printer, and with reference to FIG. 2, a developer unit 200 can be substituted in for developer units 140 in FIG. 1. In one example implementation, developer unit 200 includes a developer roller 210, a squeegee roller 220, a cleaner roller 230, and an electrode 240. Although not shown in FIG. 2, a photoconductor such as photoconductor 110 (FIG. 1) is disposed adjacent to the developer roller 210, and a surface 212 of developer roller 210 is configured to rotate to provide a layer of liquid marking agent to a rotating outer surface of the photoconductor so as to develop latent images formed upon the outer surface of the photoconductor. In some examples, the developer roller 210 is a hollow cylinder. An innermost layer of the development roller 210 is a metal core 217. A conductive rubber base layer 214 is disposed on the metal core 217. An outermost layer 215 of a protective coating is disposed on the conductive rubber base 214. The squeegee roller 220, the cleaner roller 230, and the electrode each are, or include, a conductive metal.

During a printing operation, the liquid marking agent may be introduced from a reservoir (not shown) into the developer unit 200 and flow to the surface 212 of the developer roller 210 through a chamber or passageway 242 in the electrode 240 and into a gap 245 between the electrode 240 and the developer roller 210. In one example, the gap 245 is 0.3 millimeters. The developer roller 210 rotates (in a clockwise direction in this example) and urges the liquid marking agent towards a nip 225 defined by the developer roller 210 and the squeegee roller 220 at and/or adjacent the point of contact therebetween. Squeegee roller 220 is configured to rotate in the opposite direction (in this example, counter-clockwise) to provide a substantially uniform layer of marking agent upon the surface 212 of the developer roller 210. In one example, the squeegee roller 220 removes excess liquid marking agent and packs down a layer of particles of the marking agent, such as for example ink particles, upon the surface 212. The packed down concentrated layer of ink particles is utilized to develop the latent images upon the photoconductor.

After the latent images are developed, the cleaner roller 230 rotates in the same direction as the squeegee roller 220 and operates to remove remaining ink particles from the surface 212 of the developer roller 210 at a nip 235. In some examples, a wiper (not shown) operates to remove ink particles from the cleaner roller 230 and a sponge roller (not shown) operates to mix the removed ink particles with other liquid marking agent present in the BID unit 200 for reuse.

In some developer units, the squeegee roller 220 has the same rotational surface speed as the developer roller 210. This can help avoid damage to one or both of the rollers 210, 220. However, in some cases non-uniform ities in printed output may occur if the rotational surface speeds of the roller 210, 220 are substantially the same during printing operations.

Thus in other developer units, the rotational surface speed of the squeegee roller 220 may be varied during printing operations and may differ from the rotational surface speed of developer roller 210 to improve print quality when used with certain marking agents. In one example, the squeegee roller 220 moves at a surface speed slower than the surface speed of the developer roller 210 during the presence of the liquid marking agent at the nip 225, and moves at the same speed as the developer roller 210 during the absence of the marking agent at the nip 225. However, the point during the BID drying process at which all the liquid marking agent has been removed from the nip 225 may not be precisely known or determinable, and as a result the surface speed of the squeegee roller 220 may be moving slower than the surface speed of the developer roller 210 after the nip 225 has dried. (A nip is considered to be "dry" when the two rollers that form the nip are dry, at least at the location of the nip.) This can result in undesirable excessive wear of the coating layer 215 of the developer roller 210, as has been discussed above.

During a printing operation, the ink particles may be electrically charged (negatively to −300 μC/g, in one example) to facilitate the development of latent images upon the photoconductor. In addition, the charging of the ink particles may assist with the provision of the marking agent upon the developer roller 210. In some examples, this is accomplished by independently applying various predetermined voltages to the electrode 240, the developer roller 210, the squeegee roller 220, and/or the cleaner roller 230. This in turn creates voltage differentials (voltage biases) at the nips 225, 235 and gap 245 that can charge the particles and/or direct movement of the particles in a particular direction, such as for example towards or away from the developer roller 210. The set of voltages applied to these components during a printing operation of the LEP printer are denoted as "development voltages", and the voltage biases at the nips 225, 235 and gap 245 between pairs of the components as "development voltage biases". For example, if a voltage of −1300 V is applied to the squeegee roller 220 and a voltage of −500 V to the developer roller 210, the negatively charged particles will be urged towards the developer roller 210 and away from the squeegee roller 220 at the nip 225 by the squeegee roller to developer roller voltage bias of −800 V. Also, if a voltage of −200 V is applied to the cleaner roller 230, the negatively charged particles will be urged away from the developer roller 210 and towards the cleaner roller 230 at the nip 235 by the developer roller to cleaner roller voltage bias of −300 V.

Figure 3:
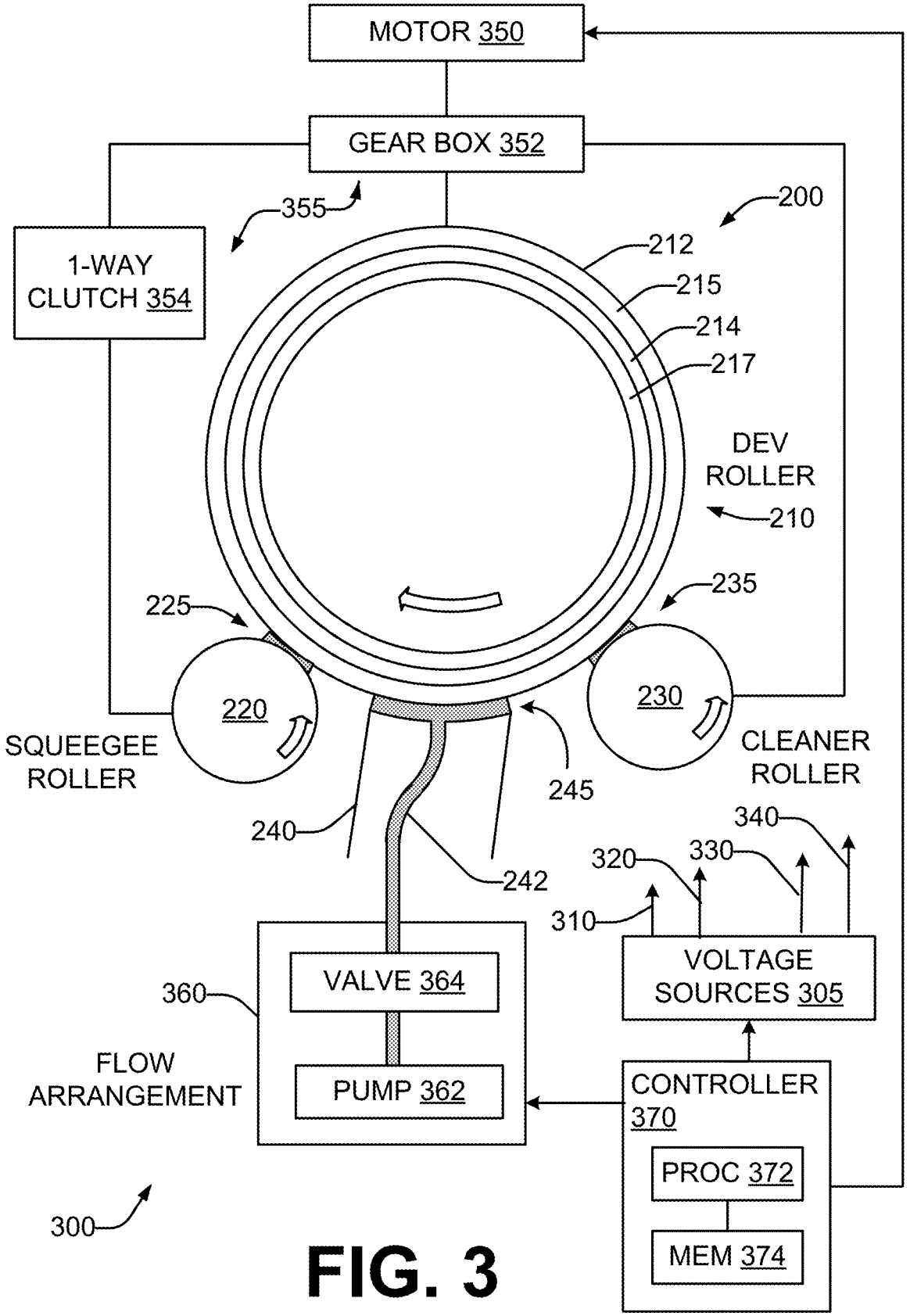
FIG. 3 is a schematic representation of a liquid electrophotographic printer according to an example of the present disclosure and including the developer unit of FIG. 2.

Considering now a liquid electrophotographic printer, and with reference to FIG. 3, a liquid electrophotographic printer 300 includes the developer unit 200. In a liquid electrophotographic printer which uses ink as the liquid marking agent, the developer unit 200 is a binary ink developer (BID) unit 200.

The printer 300 includes voltage sources 305. In one example, there are four independently controllable voltage outputs. Voltage output 310 is electrically connected to the developer roller 210. Voltage output 320 is electrically connected to the squeegee roller 220. Voltage output 330 is electrically connected to the cleaner roller 230. Voltage output 340 is electrically connected to the electrode 240.

The printer 300 includes a mechanical drive arrangement. A controllable drive motor 350 is mechanically coupled to the developer roller 210, squeegee roller 220, and cleaner roller 230 through a gearing arrangement 355. The gearing arrangement 355 includes a fixed gearbox 352 that drives the developer roller 210, squeegee roller 220, and cleaner roller 230 in lockstep. In some examples, however, the squeegee roller 220 can rotate with a different surface speed than the developer roller 210, and in such examples the gearing arrangement also includes a one-way clutch 354 coupled to the squeegee roller 220. Rotation of the motor 350 causes rotation of the rollers 210, 220, 230. The fixed gearbox 352 is mechanically coupled between the motor 350 and the rollers 210, 220, 230, and translates the rotation of the motor to associated rotation of the rollers 210, 220, 230 at fixed ratios that achieve the desired surface speeds. The gearbox 352 is directly coupled to the developer roller 210 and the cleaner roller 330. In examples where the squeegee roller 220 doesn't rotate at a slower surface speed of the developer roller 210, the gearbox 352 can also be directly coupled to the squeegee roller 200.

In examples where the squeegee roller 220 can rotate at a slower surface speed of the developer roller 210 at certain time, the gearbox 352 is indirectly coupled to the squeegee roller through the one-way clutch 354 of the gearing arrangement 355. In these examples, the squeegee roller 230 is driven by the gearbox 352 such that the surface speed of the squeegee roller 230 is slower than the surface speed of the developer roller 210. However, when the liquid marking agent in the nip 225 dries up and the roller 230 comes into contact with the developer roller 210, the one-way clutch 354 allows the squeegee roller 220 to rotate faster than the speed at which it is driven, in order to reduce friction at the point of contact between the rollers 210, 220 by matching the surface speed of the developer roller 210. However, when the motor 350 is driving the developer roller 210 at the rotational speed used during the development process ("process speed"), "skidding" of the squeegee roller 220 against the developer roller 210 as the squeegee roller 220 raises its surface speed to match that of the developer roller 210 when the rollers 210, 220 come into contact may still occur. This effect can cause an undesirable amount of friction between the rollers 210, 220 that can degrade, wear, or "scrub" the coating layer 215.

The printer 300 includes a flow arrangement 360 coupled to the chamber or passageway 242. The flow arrangement 360 controllably provides a supply of the liquid marking agent through the chamber or passageway 242 to the electrode gap 245. In some examples, the flow arrangement includes a pump 362 which draws the marking agent from a reservoir (not shown). In one example, the pump 362 is directly connected to the chamber or passageway 242. In another example, a valve 364 is disposed between the pump 362 and the chamber or passageway 242.

The printer 300 further includes a controller 370. In various examples, some or all of the controller 370 may be implemented in hardware, firmware, software, or a combination of these. In some examples where the controller 370 is implemented in whole or in part in firmware or software, the controller 370 may include a processor 372 communicatively coupled to a memory 374 having the computer executable code (e.g., firmware or software), including instructions which enable the controller 370 to selectively control the operation of the voltage sources 305, motor 305, and flow arrangement 360 including the valve 364 and pump 362. The processor 372 accesses and executes the instructions in the memory 374. The memory 374 is an example of a computer-readable storage medium having non-transitory processor-executable instructions thereon.

The controller 370 can orchestrate a process for drying the BID unit 200 after a printing operation is complete. Once the BID unit 200 has been dried, the BID unit 200 can be put in the standby or off mode without causing ink stains or morning marks on subsequent print output from the LEP printer. In one example BID drying process, the controller 370 operates the flow arrangement to enable the flow arrangement to allow liquid marking agent to flow to the electrode gap 245. In some examples the flow arrangement 360 may be enabled at the end of the printing process, and if so the controller continues to maintain the flow arrangement 360 in the enabled mode at the start of the BID drying process. In this mode, liquid marking agent continues to flow to the electrode gap 245. In some examples, the controller also sets the voltage sources 305 to the development voltages for a first period of time to begin drying the BID unit 200. At least one of the voltage sources 305 may be set to the corresponding development voltage at a different time from another of the voltage sources 305. The development voltages are selected relative to each other so as to charge the ink particles and attach them to the developer roller 210 in the electrode gap 245, and urge the charged ink particles away from the squeegee roller 220 to the developer roller 210, and away from the developer roller 210 to the cleaner roller 230 as the rollers 210, 220, 230 rotate. In this way, the particles are removed from the developer roller and from the BID unit 200 in general. The remaining oil portion of the liquid marking agent is removed from the nips 225, 235 and the gap 245 by continued rotation of the rollers 210, 220, 230.

After a period of time, the controller 370 then disables the flow arrangement 360. This may be accomplished by turning off the pump 362 and/or closing the valve 364.

Before the nips are completely dry, the controller 370 sets the voltage sources 305 to drying voltages for a second period of time. Each drying voltage is lower than the corresponding development voltage for that voltage source 305. The drying voltages maintain a similar relationship to each other as the development voltages, in order to continue to urge the charged in particles from the squeegee roller 220 to the developer roller 210, and from the developer roller 210 to the cleaner roller 230 as the rollers 210, 220, 230 rotate and continue to remove the oil from the nips 225, 235 and gap 245. The end result of the drying process is that the BID unit 200 has reduced ink residue in the gap 245 and the nips 225, 235 as compared with other drying processes.

In some examples, the controller 370 can further operate the motor 350 at different speeds during the drying process. The controller 370 operates the motor 350 at a printing process speed while the voltage sources are set to the development voltages; and at a reduced speed, slower than the printing process speed, after the voltage sources have been set to the drying voltages and before the squeegee roller nip 225 is dry enough to cause traction between the squeegee roller 220 and the developer roller 210. In one example, the process speed of the developer roller 210 during a printing operation may be 600 rpm, which results in a developer roller surface speed of 90 ips (inches per second). The reduced speed may be in the range of 5% to 25% of the process speed. Reducing the motor speed (and thus rotational speed of the developer roller 210) can advantageously minimize or inhibit skidding and/or scrubbing of the coating layer 215 by the squeegee roller 220 when the squeegee nip 225 is dry.

Figure 4:
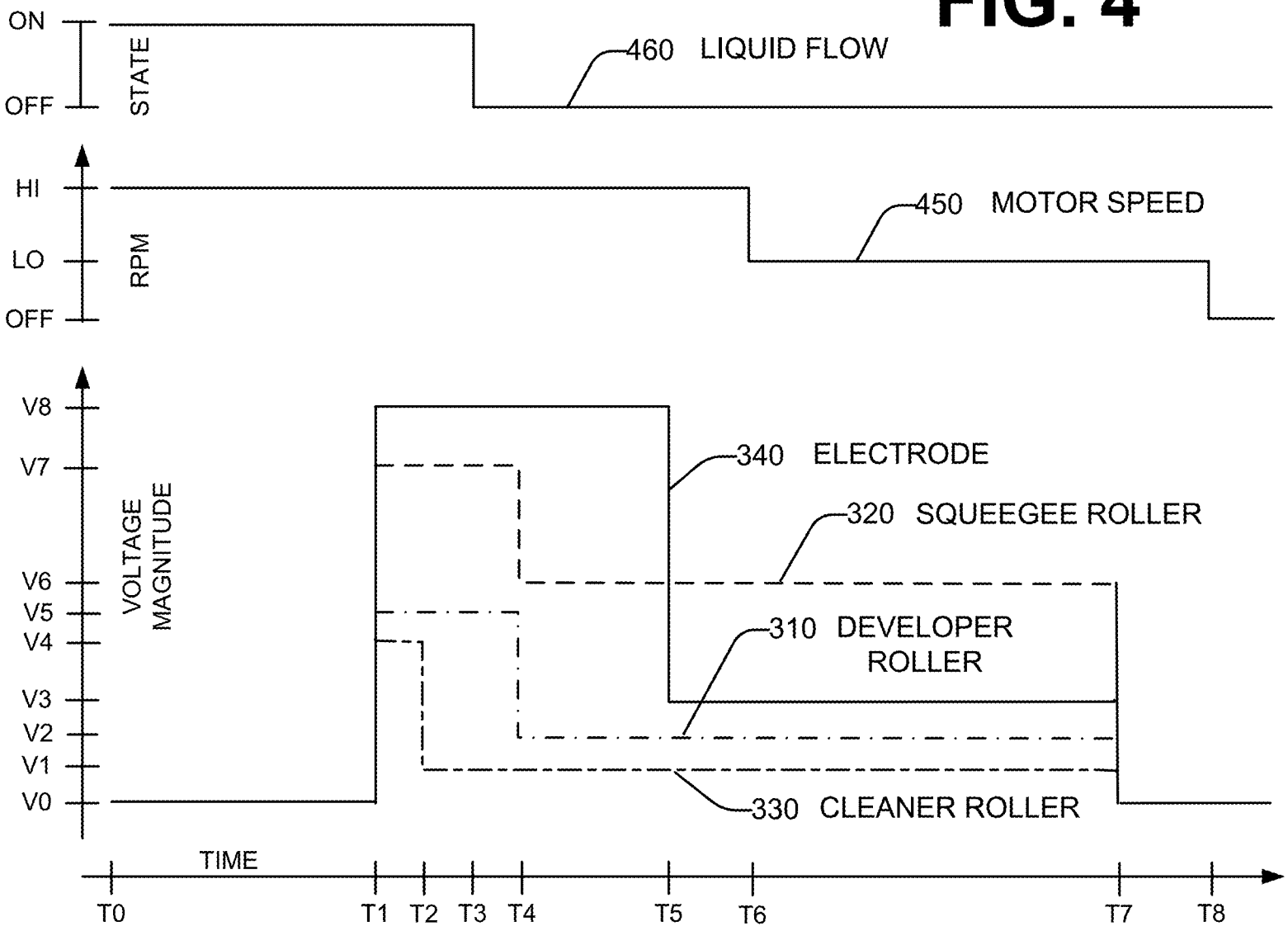
FIG. 4 is a timing diagram of component voltage magnitudes, liquid flow, and motor speed according to an example of the present disclosure and usable in the liquid electrophotographic printer of FIG. 3.

Considering now the BID unit drying operation in greater detail, and with reference to FIG. 4 and FIG. 3, a schematic timing diagram depicts the magnitudes of the voltages applied to the rollers 210, 220, 230 and electrode 240 by the voltage sources 305, the flow of liquid marking agent from the flow arrangement 360 to the developer roller 210, and the rotational speed of the motor 350 during the drying operation. For clarity of explanation, the voltages are illustrated as magnitudes (i.e. the absolute values of the voltages) instead of as signed voltages, because in some example systems all of the voltages are negative voltages (i.e. of negative polarity) rather than all positive voltages.

The drying operation begins at time T0, which occurs after a printing operation has been completed. From time T0 to time T1, the electrode voltage 340, developer roller voltage 310, squeegee roller voltage 320, and cleaner roller voltage 330 are each set to their respective idle voltages V0. While for clarity of illustration the voltages 310, 320, 330, 340 are all depicted at the same V0 value from T0 to T1, in various examples at least some of these voltages differ somewhat from others, but they are all relatively close in value, and thus the idle voltage biases between pairs of the rollers 210, 220, 230 and electrode 240 are also small. In some examples, the idle voltages, and idle voltage biases, are relatively close to zero volts when compared with the voltages and voltage biases applied at other times in the drying process.

Also from time T0 to T1, the motor rotational speed 450 is set to a high rpm value. In many examples the high rpm value corresponds to the speed which causes the developer roller 210 to rotate at the process speed. Also during this time, the state 460 of the flow arrangement 360 is set to "on", which allows liquid marking agent to continue to flow to the developer roller 210. This may be considered a "wash time" before actual drying begins.

At time T1, the voltages 310, 320, and 340 are set to development voltages V5, V7, V8 respectively. Development voltages are voltages which result in similar voltage biases—between the developer roller 210 and each of the electrode 240, squeegee roller 220, and cleaner roller 230—that exist between these components during a printing operation. In one example, the development voltage biases are within 50% of the voltages applied during a printing operation. At time T1, the voltage 330 for the cleaner roller 230 is not set to its development voltage V1, but rather to voltage V4, which has a magnitude within 10% of the development voltage V5 for the developer roller 210. This results in a small or zero voltage bias between the developer roller 210 and the cleaner roller 230 during the time between T1 and T2. At time T2, the cleaner roller voltage 330 is then set to the development voltage V1. The time delay from T1 to T2 allows sufficient time for rotation of the developer roller 210 to carry liquid marking agent introduced at the electrode gap 245 (FIG. 3) around to the nip 235 so as to wet it before a significant voltage bias between the developer roller 210 and the cleaner roller 230 is introduced. As will be discussed subsequently, this prevents a potentially damaging level of current from flowing through the developer roller 210. Setting the voltages 310, 320, 330, and 340 to their respective development voltages establishes development voltage biases between the squeegee roller 220 and the developer roller 210, between the developer roller 210 and the cleaner roller 230, and between the electrode 240 and the developer roller 210.

The period between time T2 and time T3 ensures that all the development voltages are applied and particles are being developed onto the developer roller 210. At time T3, the state 460 of the flow arrangement 360 is set to "off", which results in slowing and then stopping the flow of fresh liquid marking agent to the electrode gap 245 and the developer roller 210. The motor rotational speed 450 continues at the high rpm value. The development voltages have the effect of migrating the charged particles in the remaining liquid marking agent from the electrode gap 245 to the developer roller 210, from the squeegee roller 220 to the developer roller 210, and from the developer roller 210 to the cleaner roller 230 for removal. This leaves behind the oil portion of the liquid marking agent, which is removed from the nips 225, 235 and the electrode gap 245 by the continued rotation of the rollers.

With the flow arrangement 360 "off", the liquid marking agent in the gap 245 drains and is eliminated by the spinning of the developer roller 210. As the marking agent on the spinning developer roller 210 comes into contact with the cleaner roller 230, a splitting of the marking agent layer on the developer roller 210, with one portion migrating to the cleaner roller 230 and the other portion remaining on the developer roller 210. Over multiple rotations, with no new marking agent being supplied to the developer roller 210, all the remaining marking agent will be removed.

At time T4, the voltages 310, 320 are reduced to drying voltages V2 and V6 respectively, which are smaller in magnitude than the corresponding development voltages V5 and V7. In some examples, the voltage 330 is maintained at its previous value, although in other examples it may be changed. As a result of these voltage reductions, the voltage biases between the squeegee roller 220 and the developer roller 210, and between the developer roller 210 and the cleaner roller 230, are reduced to smaller drying voltage biases. Then at time T5, the voltage 340 is reduced to drying voltage V3, smaller in magnitude than the corresponding development voltage V8.

The voltages 310, 320 are reduced at time T4, rather than later, in order to ensure that the nips 225, 235 are still wet at the time of the voltage reductions. These reductions prevent a potentially damaging level of current from flowing between the developer roller 210 and at least one of the squeegee roller 220 and cleaner roller 230 at their nip 225, 235. The squeegee and cleaner rollers 220, 230 are metallic, with a resistance on the order of 1Ω. The developer roller 210 has a metal core 217 below a surface coating 215 and a conductive rubber base 214, resulting in a resistance on the order of 50 kΩ at the surface. A wet nip has a resistance that is on the order of 400 kΩ, while a dry nip has a resistance that is on the order of 100Ω. This difference in resistance at the nip is due at least in part to less contact between the rollers occurring at a wet nip than at a dry nip (the marking agent, which has a high resistivity, can form a layer about 8 micrometers in thickness). Thus when the developer roller 210 contacts another roller 220, 230 at a wet nip, and example development voltages of 650 V and 275 V are applied to the respective rollers, the current flow is about 0.8 mA. However, when the developer roller 210 contacts another roller 220, 230 at a dry nip, and these development voltages are applied to each roller, the current flow is about 7.5 mA. This higher current can damage the conductive rubber base 214 of the developer roller 210. In some examples, the damage results from the high current in the developer roller 210 removing the ions that give the conductive rubber base 214 the proper resistivity. To avoid such damage at a dry nip, the development voltages are reduced to the lower drying voltages at time T4 before the nips 225, 235 are fully dry. The lower voltages still promote ink particle removal via the mechanisms that have been described, but the reduced voltage biases between the squeegee roller 220 and the developer roller 210, and between the developer roller 210 and the cleaner roller 230, reduce the amount of current in the developer roller 210. For example, if drying voltages of 220 V and 90 V are applied to the two rollers, the current flow is about 2.6 mA, which minimizes damage to the conductive rubber base 214. Because the electrode 240 does not contact the developer roller 210 under any circumstances during the drying process, the voltage 340 can be maintained at the development voltage until time T5 to promote further ink particle migration and removal at the gap 245. The electrode gap 245 becomes dry by time T5, and so the voltage 340 is reduced from its development voltage V8 to its lower, drying voltage V3.

At time T6, the motor rotational speed 450 is set to a lower (reduced) rpm value. The lower speed minimizes or eliminates the skidding or scrubbing between the squeegee roller 230 and the developer roller 210 at a dry nip 225. This in turn reduces or minimizes the wear of the surface coating 215 of the developer roller 210. During the period from time T6 to time T7, the lower rotational speed allows additional mechanical drying to be performed without risk of skidding or scrubbing.

At time T7, the roller and electrode voltages 310, 320, 330, and 340 are transitioned back to their respective idle voltages. In some examples, all the voltages do not transition back to their idle values at precisely the same time, but rather this transition occurs in a sequential fashion that is complete by time T7.

At time T8, the drying process is complete, and the motor rotational speed 450 is set to zero, turning the motor 350 off. The period between time T7 and time T8 ensures that all the voltages 310, 320, 330, and 340 are set to idle voltages before the motor 350 is turned off, in order to prevent damage to the BID unit.

The times and/or the voltages may be tuned for the particular components of the BID unit and/or the particular liquid marking agents used for printing. The times and voltages may be determined from a calibration procedure performed on the BID unit during manufacturing or in the field. Although in FIG. 4 the voltage magnitudes of voltages V0 through V8 increase from V0 through V8, in other examples the magnitudes of the voltages V0 through V8 may be ordered differently.

Considering now one example BID unit in which the voltages 310, 320, 330, and 340 are negative voltages, the process speed is 1715 rpm, the reduced speed is 200 rpm, and the voltages 310, 320, 330, and 340 at times T0 through T8 are as follows:

| | Time | Electrode Voltage 340 | Squeegee Roller Voltage 320 | Developer Roller Voltage 310 | Cleaner Roller Voltage 330 |
|---|---|---|---|---|---|
| T0 | 0 sec | 0 V | 0 V | 0 V | 0 V |
| T1 | 4.0 sec | −825 V | −700 V | −325 V | −300 V |

-continued

| | Time | Electrode Voltage 340 | Squeegee Roller Voltage 320 | Developer Roller Voltage 310 | Cleaner Roller Voltage 330 |
|---|---|---|---|---|---|
| T2 | 4.1 sec | −825 V | −700 V | −325 V | 0 V |
| T3 | 5.0 sec | −825 V | −700 V | −325 V | 0 V |
| T4 | 5.5 sec | −825 V | −275 V | −125 V | 0 V |
| T5 | 7.0 sec | −125 V | −275 V | −125 V | 0 V |
| T6 | 8.0 sec | −125 V | −275 V | −125 V | 0 V |
| T7 | 14.0 sec | 0 V | 0 V | 0 V | 0 V |
| T8 | 15.0 sec | 0 V | 0 V | 0 V | 0 V |

Relating this example BID unit to FIG. 4, the voltage magnitudes are defined as follows:

| | Voltage |
|---|---|
| V8 | 825 V |
| V7 | 700 V |
| V6 | 275 V |
| V5 | 325 V |
| V4 | 300 V |
| V3 | 125 V |
| V2 | 125 V |
| V1 | 0 V |
| V0 | 0 V |

The above table indicates that, for this example, V0 and V1 are the same voltage, and V2 and V3 are the same voltage. In addition, V6 is smaller in magnitude than V5.

Figure 5:
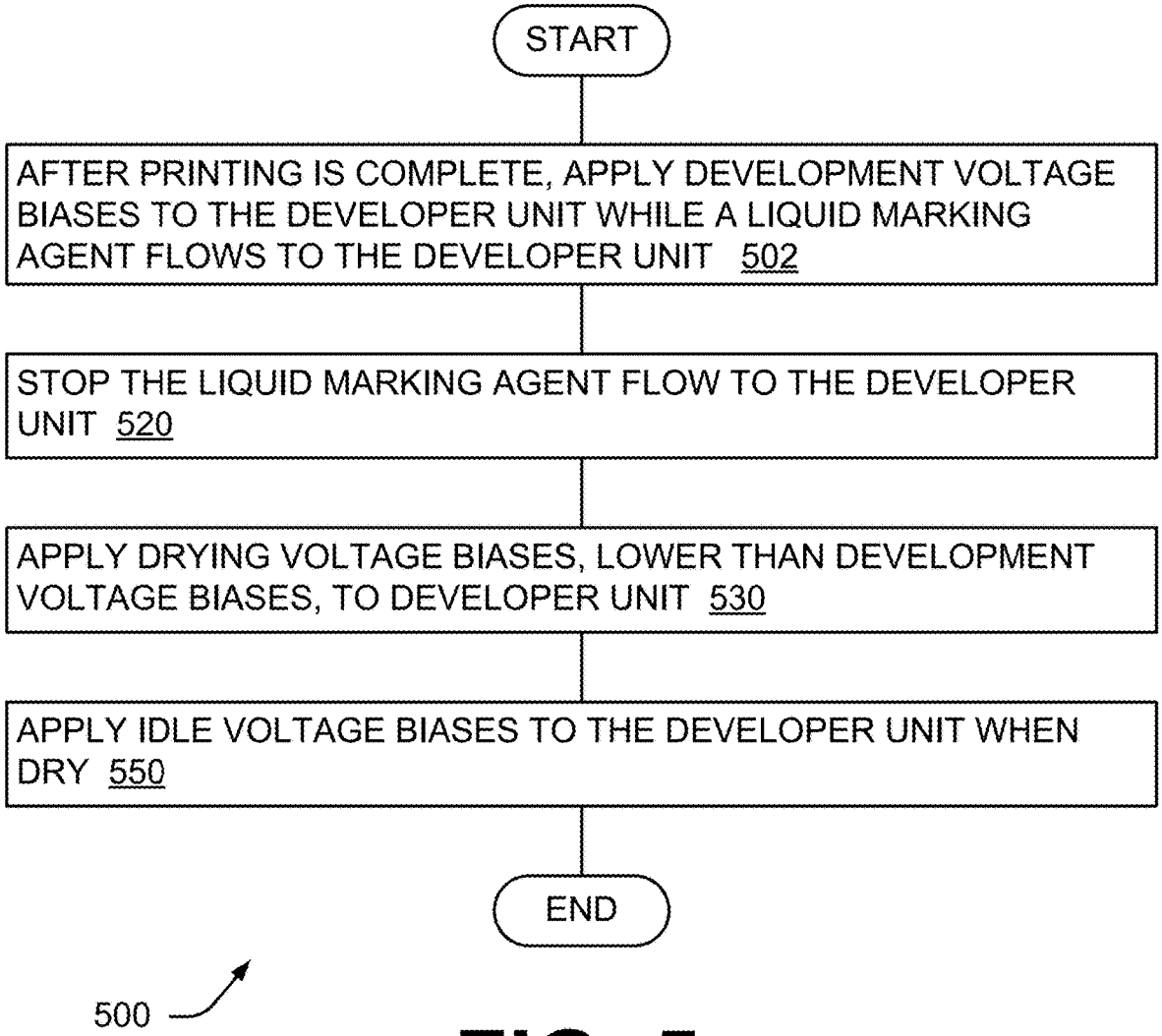
FIG. 5 is a flowchart in accordance with an example of the present disclosure of a method of drying a developer unit of a liquid electrophotographic printer.

Consider now, with reference to FIG. 5, a flowchart of a method of drying a developer unit of a liquid electrophotographic printer. In some examples, the flowchart of FIG. 5 may be considered as at least a portion of a method implemented in a controller of the liquid electrophotographic printer. A method 500 begins at 502 by applying, after a printing operation is complete, development voltage biases to the developer unit while a liquid marking agent flows to the developer unit. At 520, the liquid marking agent flow to the developer unit is stopped. At 530, drying voltage biases lower than the development voltage biases are applied to the developer unit before the unit is dry. At 550, idle voltage biases are applied to the developer unit when the unit is dry.

Figure 6A:
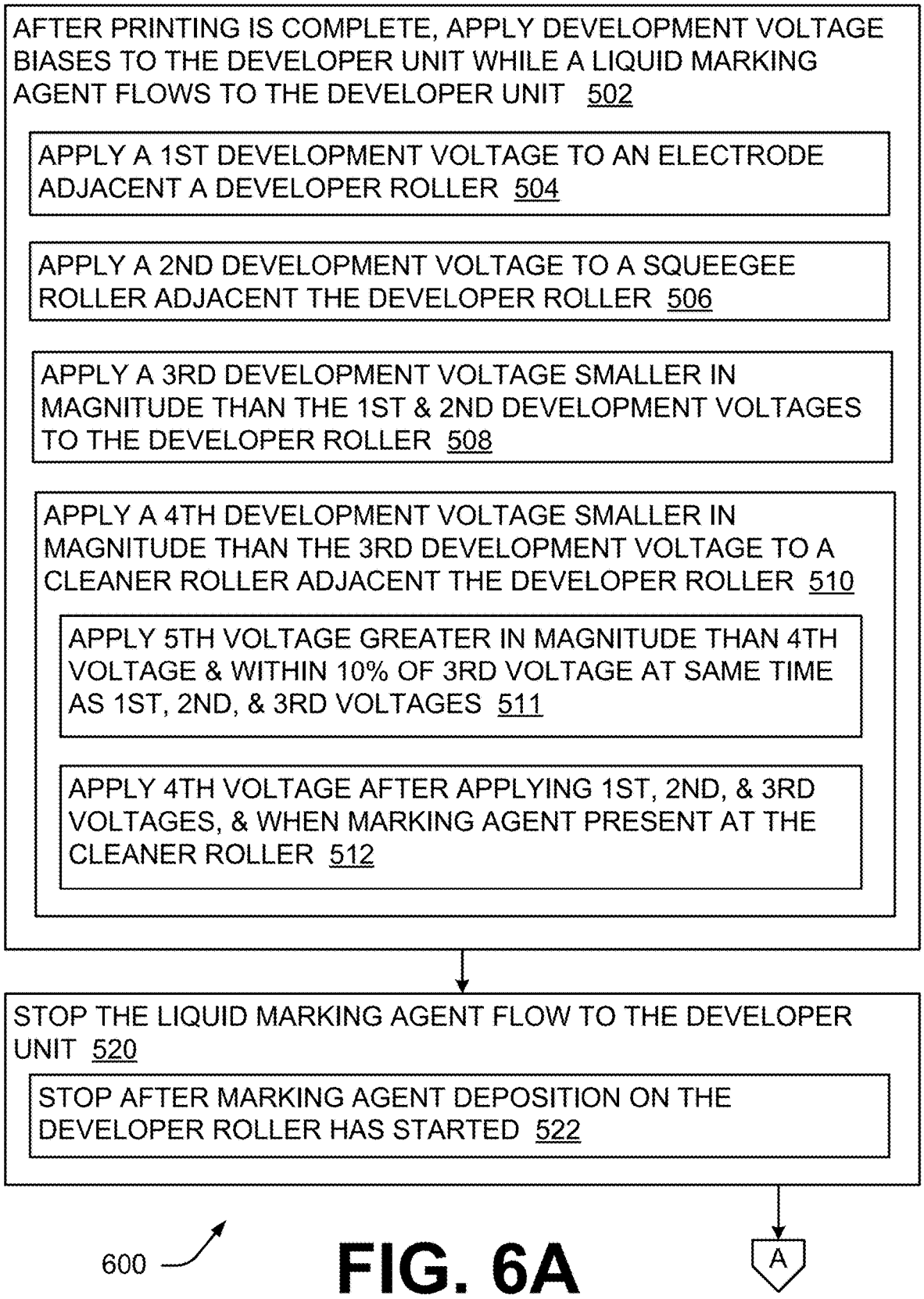
FIGS. 6A-6B are another flowchart in accordance with an example of the present disclosure of a method of drying a developer unit of a liquid electrophotographic printer.
Figure 6B:
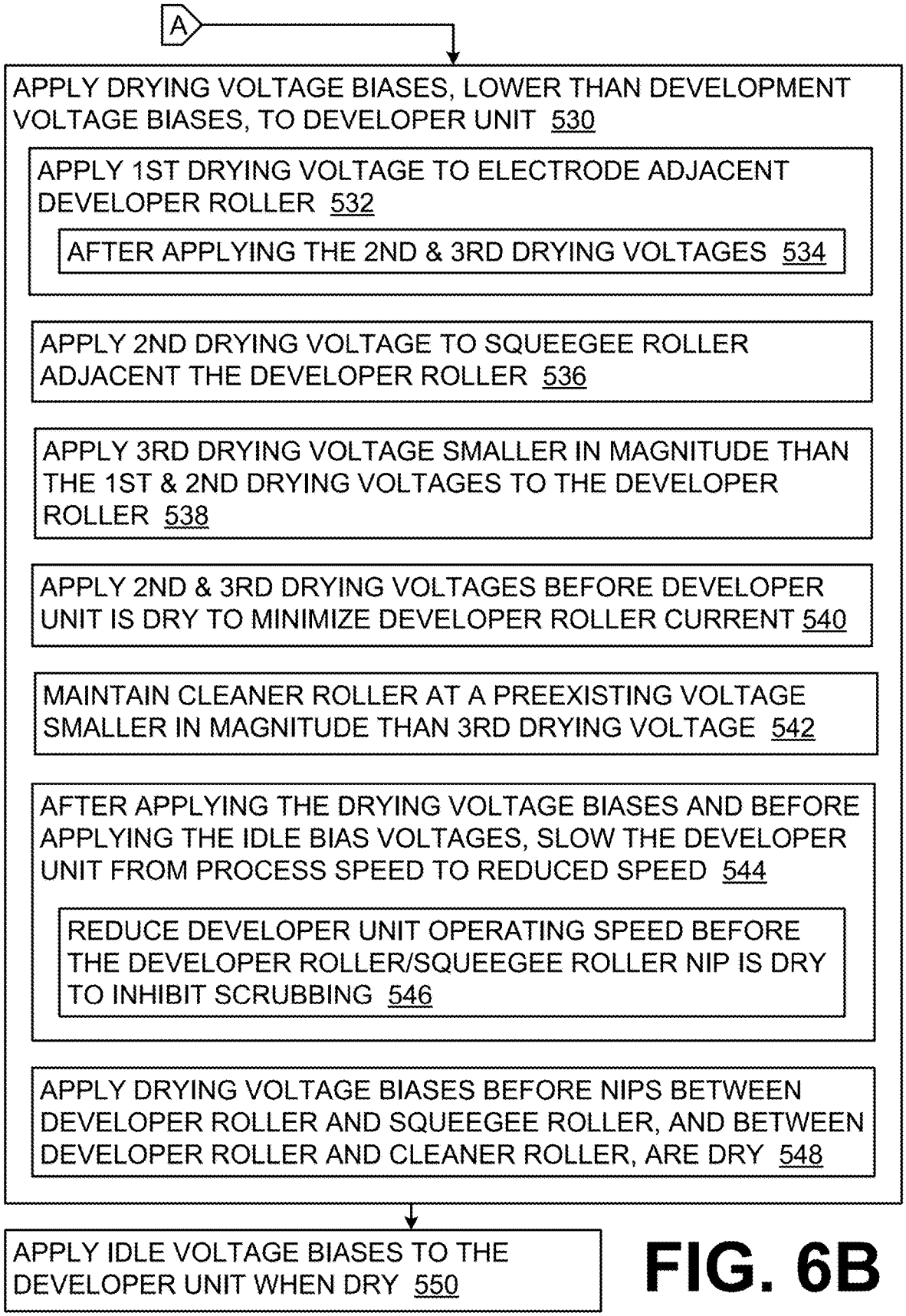

Consider now, with reference to FIGS. 6A-6B, a flowchart of a method of drying a developer unit of a liquid electrophotographic printer. In some examples, the flowchart of FIGS. 6A-6B may be considered as at least a portion of a method implemented in a controller of the liquid electrophotographic printer. A method 600 begins at 502 by applying, after a printing operation is complete, development voltage biases to the developer unit while a liquid marking agent flows to the developer unit. In some examples, a first development voltage is applied to an electrode adjacent a developer roller at 504, a second development voltage is applied to a squeegee roller adjacent the developer roller at 506, a third development voltage smaller in magnitude than the first and second development voltages is applied to the developer roller at 508, and a fourth development voltage smaller in magnitude than the third development voltage is applied to a cleaner roller adjacent the developer roller at 510. In some cases, applying the fourth development voltage at 510 includes, at 511, applying a fifth development voltage to the cleaner roller at the first time, the fifth development voltage having a magnitude greater than the fourth development voltage and within 10% of the third development voltage; and at 512, applying the fourth development voltage to the cleaner roller at a second time subsequent to the first time, after the liquid marking agent becomes present adjacent the cleaner roller.

At 520, the liquid marking agent flow to the developer unit is stopped. In some examples, at 522, this flow of liquid marking agent is stopped after liquid marking agent deposition on the developer roller has started.

At 530, drying voltage biases lower than the development voltage biases are applied to the developer unit before the unit is dry. In some examples, a first drying voltage is applied to an electrode adjacent a developer roller at 532, a second drying voltage is applied to a squeegee roller adjacent the developer roller at 536, a third drying voltage smaller in magnitude than the first and second development voltages is applied to the developer roller at 538, and at 542 the cleaner roller maintained at a preexisting voltage smaller in magnitude than the third drying voltage. In some examples, at 540, the second and third drying voltages are applied at a first time, before the developer unit is dry, to minimize current flow in the developer roller. In some examples, at 534, the second and third drying voltages are applied at a first time, before the developer unit is dry, to minimize current flow in the developer roller, and the first drying voltage is applied at a later second time. In some examples, at 544, the developer unit is slowed from a process speed to a reduced speed after the lower drying voltage biases are applied and before the idle bias voltages are applied. In some of these examples, at 546, the developer unit operating speed is reduced before the nip is dry to inhibit scrubbing between the developer and squeegee rollers where a surface of the squeegee roller rotates slower than a surface of a developer roller at a nip between the two rollers. In some examples, at 548, the drying voltage biases are applied before nips in the unit between the developer roller and the squeegee roller, and between the developer roller and the cleaner roller, are dry.

At 550, idle voltage biases are applied to the developer unit when the unit is dry.

In one example, all of the development voltages and drying voltages of FIG. 5 are of negative polarity (i.e. they are negative voltages).

From the foregoing it will be appreciated that the developer unit, method, and medium provided by the present disclosure represent a significant advance in the art. Although several specific examples have been described and illustrated, the disclosure is not limited to the specific methods, forms, or arrangements of parts so described and illustrated. This description should be understood to include all combinations of elements described herein, and claims may be presented in this or a later application to any combination of these elements. The foregoing examples are illustrative, and different features or elements may be included in various combinations that may be claimed in this or a later application. Unless otherwise specified, operations of a method claim need not be performed in the order specified. Similarly, blocks in diagrams or numbers (such as (1), (2), etc.) should not be construed as operations that proceed in a particular order. Additional blocks/operations may be added, some blocks/operations removed, or the order of the blocks/operations altered and still be within the scope of the disclosed examples. Further, methods or operations discussed within different figures can be added to or exchanged with methods or operations in other figures. Further yet, specific numerical data values (such as specific quantities, numbers, categories, etc.) or other specific information should be interpreted as illustrative for discussing the examples. Such specific information is not provided to limit examples. The disclosure is not limited to the above-described implementations, but instead is defined by the appended claims in light of their full scope of equivalents. Where the claims recite "a" or "a first" element of the equivalent thereof, such claims should be understood to include incorporation of at least one such element, neither requiring nor excluding two or more such elements. Where the claims recite "having", the term should be understood to mean "comprising".

What is claimed is:

1. A method of drying a developer unit of a liquid electrophotographic printer, comprising:

after printing is complete, applying a development voltage bias to the developer unit while a liquid marking agent flows to the developer unit;

after applying the development voltage bias, stopping the liquid marking agent flow to the developer unit; and after the stopping, applying a drying voltage bias, lower than the development voltage bias, to the developer unit.

2. The method of claim 1, further comprising:

after applying the drying voltage bias, applying an idle voltage bias to the developer unit.

3. The method of claim 2, further comprising:

after applying the drying voltage bias and before applying the idle voltage bias, slowing the developer unit from a process speed to a reduced speed.

4. The method of claim 1, wherein applying the development voltage bias comprises applying the development voltage bias to an electrode adjacent a developer roller.

5. The method of claim 1, wherein applying the development voltage bias comprises applying the development voltage bias to a squeegee roller adjacent a developer roller.

6. The method of claim 1, wherein applying the development voltage bias comprises applying a first development voltage bias to an electrode adjacent or a squeegee roller adjacent a developer roller, and wherein the method further comprises applying a second development voltage bias smaller in magnitude than the first development voltage bias to the developer roller.

7. The method of claim 1, wherein applying the development voltage bias comprises applying a first development voltage bias to a developer roller, and wherein the method further comprises applying a second development voltage bias smaller in magnitude than the first development voltage bias to a cleaner roller adjacent the developer roller.

8. The method of claim 1, wherein the liquid marking agent comprises charged colorant particles in a carrier liquid, and wherein the development and drying voltage biases urge the particles from an electrode gap and a squeegee roller to an adjacent developer roller, and from the developer roller to an adjacent cleaner roller for removal from the developer unit.

9. The method of claim 1, wherein the flow of liquid marking agent is stopped after liquid marking agent deposition on the developer roller has started; and wherein the drying voltage bias is applied before nips in the unit between a developer roller and a squeegee roller, and between the developer roller and a cleaner roller, are dry.

10. The method of claim 1, wherein applying the drying voltage bias comprises applying the drying voltage bias to an electrode adjacent a developer roller.

11. The method of claim 1, wherein applying the drying voltage bias comprises applying the drying voltage bias to a squeegee roller adjacent the developer roller.

12. The method of claim 1, wherein applying the drying voltage bias comprises applying a first drying voltage bias to an electrode or squeegee roller adjacent the developer roller, and wherein the method further comprises applying a second drying voltage bias smaller in magnitude than the first drying voltage bias to the developer roller.

13. The method of claim 1, wherein applying the drying voltage bias comprises applying the drying voltage bias to a developer roller, and wherein the method further comprises maintaining a cleaner roller at a preexisting voltage bias smaller in magnitude than the drying voltage bias.

14. A liquid electrophotographic printer, comprising:

a developer unit to develop a latent image, comprising a set of rollers defining plural nips, and an electrode adjacent one of the rollers defining a gap;

a flow arrangement to provide charged ink to the rollers adjacent the electrode;

a plurality of voltage sources each to apply a corresponding voltage to one of the rollers and the electrode; and a controller to enable the flow arrangement, after enabling the flow arrangement, set the plurality of voltage sources to a plurality of development voltages for a first time, disable the flow arrangement, and after disabling the flow arrangement, set the plurality of voltage sources to a plurality of drying voltages lower than the plurality of development voltages for a second time.

15. The printer of claim 14, wherein the set of multiple rollers includes a developer roller having a coating to develop a latent image on a photoconductor adjacent the developer roller, and a squeegee roller adjacent the developer roller at a squeegee nip, comprising:

a motor driving the set of multiple rollers through a gearing arrangement that enables the squeegee roller to rotate at a slower surface speed than the developer roller, wherein the controller is further to operate the motor to rotate the developer roller at a printing process speed while the plurality of voltage sources are set to the plurality of development voltages, and at a reduced speed, slower than the printing process speed, after the plurality of voltage sources have been set to the drying voltages.

16. The printer of claim 14, wherein the set of multiple rollers comprises:

a developer roller to develop a latent image on a photoconductor adjacent the developer roller;

a squeegee roller adjacent the developer roller at a squeegee nip;

a cleaner roller adjacent the developer roller at a cleaner nip, wherein the plurality of development voltages and the drying voltages urge charged particles in the ink from the electrode gap and the squeegee roller to the developer roller, and from the developer roller to the cleaner roller.

17. A computer-readable storage medium having non-transitory processor-executable instructions thereon which, when executed by a processor, cause the processor to:

enable flow of a charged ink to a developer roller disposed in a binary ink developer unit at a gap from an adjacent electrode and defining nips at adjacent squeegee and cleaner rollers;

set a voltage source coupled to a selected roller to a development voltage for a first time period;

disable flow of the charged ink; and after disabling flow of the charged ink, set the voltage source to a drying voltages lower than the development voltage for a second time period.

18. The computer-readable storage medium of claim 17, wherein the instructions further cause the processor to:

operate a motor, coupled to the rollers through a gearing arrangement which rotates the squeegee roller at a slower surface speed than the developer roller, to drive the developer roller at a development process speed while the voltage source is set to the development voltage, wherein the developer roller has a coating to develop a latent image on an adjacent photoconductor; and operate the motor to drive the developer roller at a reduced speed, slower than the development process speed, after the voltage source has been set to the drying voltage, so as to inhibit damage to the coating by the squeegee roller when the squeegee nip is dry.

19. The computer-readable storage medium of claim 17, wherein the instructions further cause the processor to:

set the voltage source to an idle voltage lower than the drying voltage after the second time period.

* * * * *